US008210529B2

(12) United States Patent
Trudeau et al.

(10) Patent No.: US 8,210,529 B2
(45) Date of Patent: Jul. 3, 2012

(54) FEED INPUT ASSEMBLY FOR VARIABLE LENGTH SHEET MATERIAL

(75) Inventors: Joseph A. Trudeau, Watertown, CT (US); Joseph F. Zuzick, Shelton, CT (US); Ralph A. Rapillo, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 167 days.

(21) Appl. No.: 12/751,047

(22) Filed: Mar. 31, 2010

(65) Prior Publication Data

US 2011/0241276 A1 Oct. 6, 2011

(51) Int. Cl.
*B65H 5/02* (2006.01)

(52) U.S. Cl. ..... 271/273; 271/275

(58) Field of Classification Search ..... 271/3.14, 271/3.18, 3.2, 3.21, 3.24, 272, 273; 198/626.3, 198/626.4

See application file for complete search history.

(56) References Cited

U.S. PATENT DOCUMENTS 4,385,537 A * 5/1983 Wolf ..... 83/100

* cited by examiner

*Primary Examiner* — Michael McCullough

(74) *Attorney, Agent, or Firm* — Brian A. Collins; Charles R. Malandra, Jr.; Steven J. Shapiro

(57) ABSTRACT

A feed input assembly for accepting and conveying sheet material of variable length along a feed path including a processing station for performing an operation on the sheet material and an ingestion assembly adapted to capture the sheet material between the opposed friction drive surfaces and accept a leading edge of the sheet material from the processing station at a point of entry. The ingestion assembly includes transport elements having positionable opposed friction drive surfaces which are adapted to vary point of entry along the feed path. By varying the point of entry, sheet material of variable length can be accepted without varying the position of the processing station relative to the ingestion assembly. Also, a method for operating a feed input assembly having positionable friction drive surfaces.

8 Claims, 5 Drawing Sheets

FEED INPUT ASSEMBLY FOR VARIABLE LENGTH SHEET MATERIAL

FIELD OF THE INVENTION

The present invention relates to an assembly for handling sheet material used in the creation of mailpieces, and more particularly, to a feed input assembly and method for feeding sheet material which varies in length.

BACKGROUND OF THE INVENTION

Various apparatus are employed for arranging sheet material in a package suitable for use or sale in commerce. One such apparatus, useful for describing the teachings of the present invention, is a mailpiece inserter system employed in the fabrication of high volume mail communications, e.g., mass mailings. Such mailpiece inserter systems are typically used by organizations such as banks, insurance companies, and utility companies for producing a large volume of specific mail communications where the contents of each mailpiece are directed to a particular addressee. Also, other organizations, such as direct mailers, use mail inserters for producing mass mailings where the contents of each mail piece are substantially identical with respect to each addressee. Examples of inserter systems are the 8 series, 9 series, and APS™ inserter systems available from Pitney Bowes Inc. located in Stamford, Conn., USA.

In many respects, a typical inserter system resembles a manufacturing assembly line. Sheets and other raw materials (i.e., a web of paper stock, enclosures, and envelopes) enter the inserter system as inputs. Various modules or workstations in the inserter system work cooperatively to process the sheets until a finished mail piece is produced. For example, in a mailpiece inserter, an envelope is conveyed downstream utilizing a transport mechanism, such as rollers or a belt, to each of the modules. Such modules include, inter alia, (i) a web for feeding printed sheet material, i.e., material to be used as the content material for mailpiece creation, (ii) a module for cutting the printed sheet material to various lengths, (iii) a feed input assembly for accepting the printed sheet material from the cutting module, (iv) a folding module for folding mailpiece content material for subsequent insertion into the envelope, (v) a chassis module where sheet material and/or inserts, i.e., the content material, are combined to form a collation, (vi) an inserter module which opens an envelope for receipt of the content material, (vii) a moistening/sealing module for wetting the flap sealant to close the envelope, (viii) a weighing module for determining the weight of the mailpiece for postage, and (x) a metering module for printing the postage indicia based upon the weight and/or size of the envelope, i.e., applying evidence of postage on the mailpiece. While these are some of the more commonly used modules for mailpiece creation, it will be appreciated that the particular arrangement and/or need for specialty modules, are dependent upon the needs of the user/customer.

Inasmuch as a mailpiece inserter comprises a plurality of modules, it is desirable to reduce the feed path, and, hence the "foot-print" occupied by the inserter. That is, inasmuch as the real-estate occupied by a mailpiece inserter translates into cost for an operator, it is desirable to reduce the space consumed by the inserter. Each foot of feed path which can be reduced, translates into savings for the consumer.

One area where space savings is typically lost is the transition between the cutting module and the feed input assembly due to the variability in the length of content material to be processed. That is, since the length of content material can vary from a short insert, i.e., approximately four and one-half inches (4½"), to a double long sized sheet, i.e., approximately seventeen inches (17"), the feed path between the cutting module and feed input assembly may vary by more than one foot or twelve inches 12". Stated in yet other terms, the point of entry/ingestion of the leading edge of a long sheet can lengthen the feed path of the inserter as compared to the entry point required by a short insert, e.g., the location of a nip for ingesting the leading edge of the insert.

A need, therefore, exists for a feed input assembly which accepts variable length sheets from an upstream processing module, such as a cutting module, while minimizing the feed path of a mailpiece inserter.

SUMMARY OF THE INVENTION

A feed input assembly is provided for accepting and conveying sheet material of variable length along a feed path including a processing station for performing an operation on the sheet material and an ingestion assembly adapted to capture the sheet material between the opposed friction drive surfaces and accept a leading edge of the sheet material from the processing station at a point of entry. The ingestion assembly includes transport elements having positionable opposed friction drive surfaces which are adapted to vary point of entry along the feed path. By varying the point of entry, sheet material of variable length can be accepted without varying the position of the processing station relative to the ingestion assembly. A method for operating a feed input assembly having positionable friction drive surfaces is also described.

BRIEF DESCRIPTION OF THE DRAWINGS

Further details of the present invention are provided in the accompanying drawings, detailed description, and claims.

DETAILED DESCRIPTION

Figure 1A:
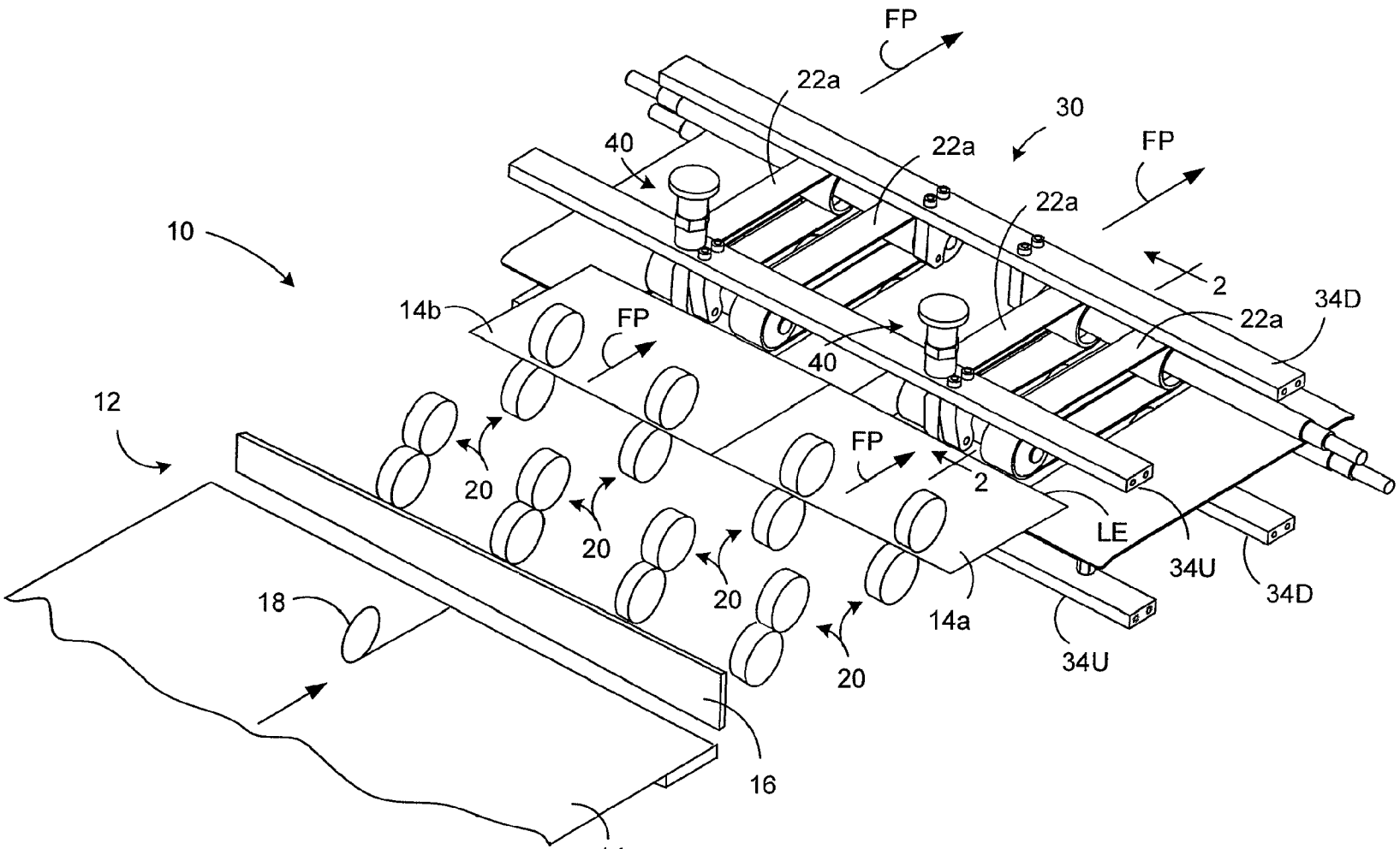
FIG. 1*a* is a perspective view of the feed input assembly in combination with a cutting assembly upstream of the feed input assembly wherein the feed input assembly accepts a short inert produced by the cutting assembly.
Figure 1B:
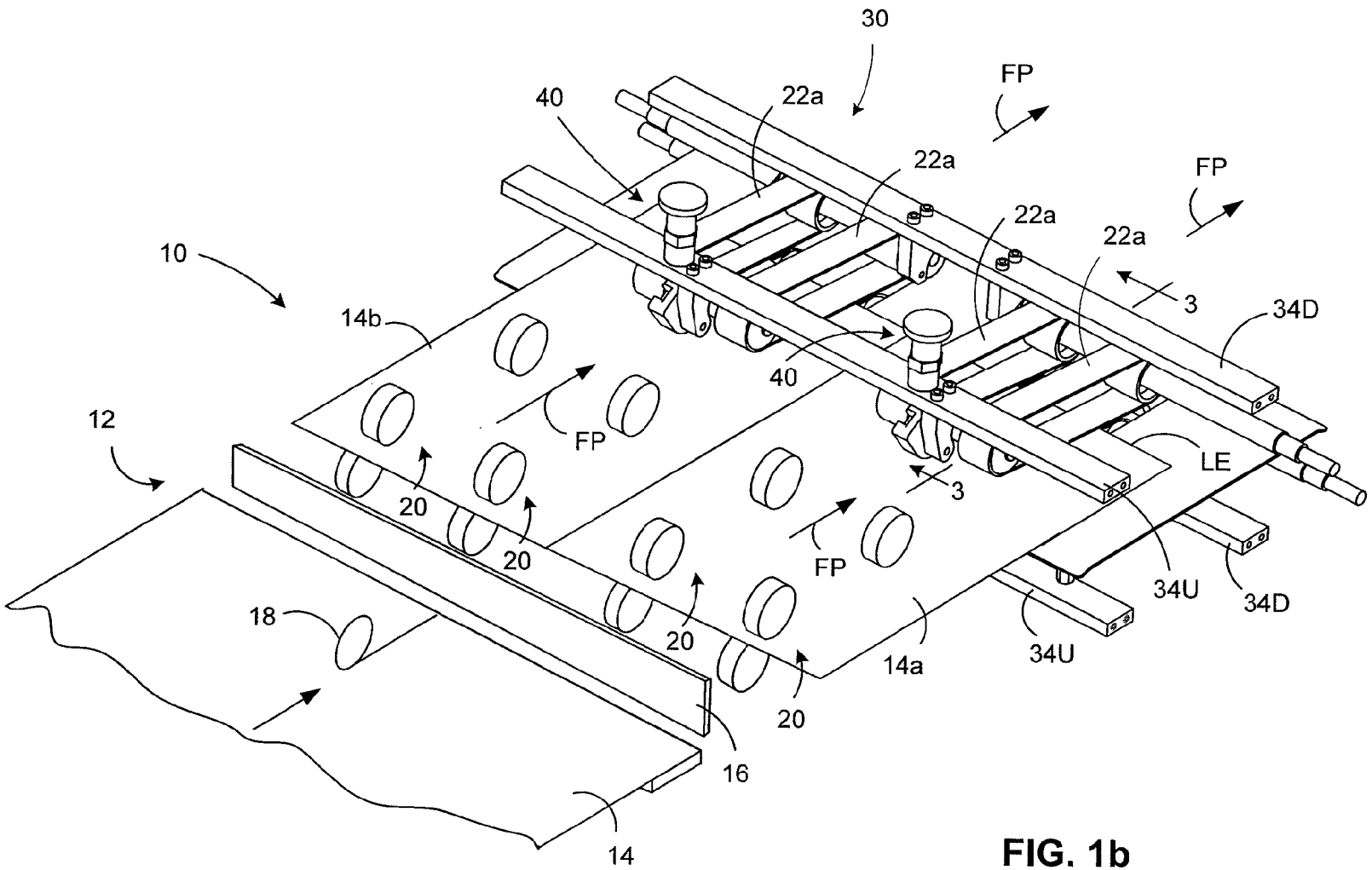
FIG. 1*b* is a perspective view of the feed input assembly in combination with the cutting assembly wherein the feed input assembly accepts a double length piece of sheet material from the cutting assembly.

The present invention is described in the context of a feed input assembly wherein sheet material of variable length may be accepted and processed without impacting the overall length of the sheet material feed path and the space occupied by the assembly. In FIGS. 1*a* and 1*b*, the feed input assembly 10 includes a processing station 12 which performs an operation on sheets of material 14. The processing station 12 includes a first galantine-type cutting apparatus 16 operative to cut sheet material 14 from a web of rolled sheet material (not shown) and a second rotary cutter 18 operative to effect a longitudinal cut along the web. With respect to the latter, the rotary cutter 18 splits the web to form side-by-side sheets 14*a*, 14*b* thereby doubling the output capacity of the processing station 12. In FIG. 1*a*, the feed input assembly 10 processes sheet material 14*a*, 14*b* which is short in length, e.g., short inserts having a length of about four and one-half inches (4½") while in FIG. 1*b*, the feed input assembly 10 is shown processing sheet material 14*a*, 143*b* which is a longer length, e.g., double-sized sheets having a length of about seventeen inches (17").

Once cut, each of the sheet materials 14*a*, 14*b* is taken away by one or more pairs of drive nips 20 and conveyed along a feed path FP. While the described embodiment shows the sheet material 14*a*, 14*b* being conveyed along two, side-by-side feed paths FP, the following discussion emphasizes the feed input assembly 10 as it pertains to a single feed path, i.e., the feed path associated with the right-hand side of the feed input assembly 10 or the path conveying sheet material 14*a*.

In FIGS. 1*a*-3, the sheet material then enters an ingestion assembly 30 having transport elements 22*a*, 22*b* including opposed friction drive surfaces 24*a*, 22*b* adapted to capture the sheet material 14*a* therebetween and accept a leading edge LE of the sheet material 14*a* from the processing station 12 at a point of entry PE. According to one embodiment of the invention, the ingestion assembly 30 is adapted to vary the position of the friction drive surfaces 24*a*, 24*b* to vary point of entry PE of the leading edge LE along the feed path FP. Furthermore, by varying the point of entry PE, sheet material 14*a* of variable length can be accepted without varying the position of the processing station 12 relative to the ingestion assembly 30. In the context used herein, the "point of entry" means any opposed friction drive surfaces which are capable of securing sheet material along each surface and driving the sheet material along a feed path. The friction drive surfaces may include opposed elements such as nips or belts, whether each is being driven, or one is driven while the other remains idle or follows.

Figure 2:
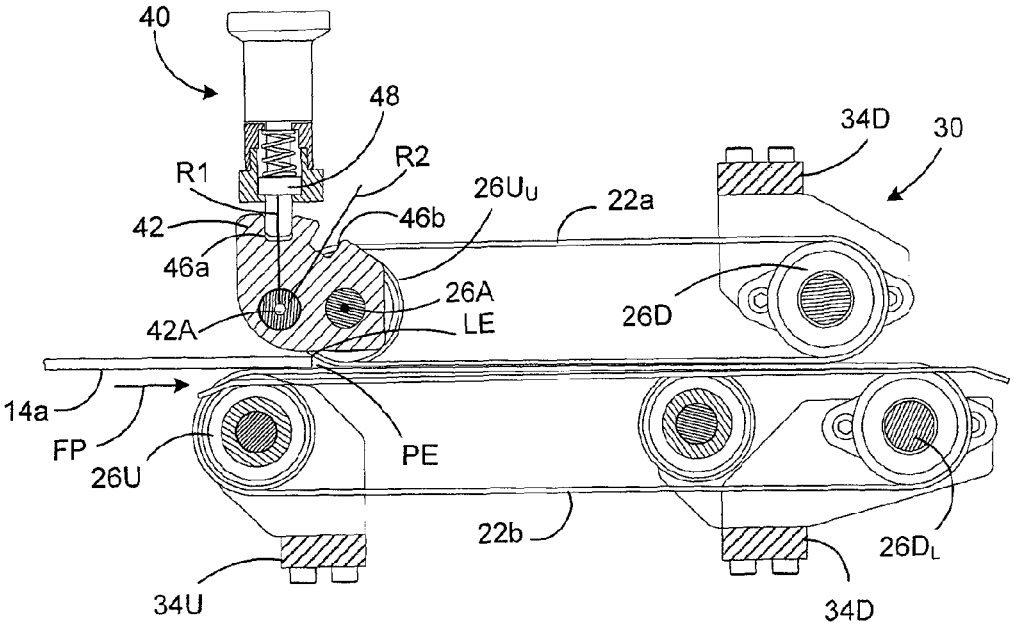
FIG. 2 is sectional view taken substantially along line 2-2 of FIG. 1*a* wherein the leading edge of the short insert is accepted into an ingestion assembly at a first point of entry.
Figure 3:
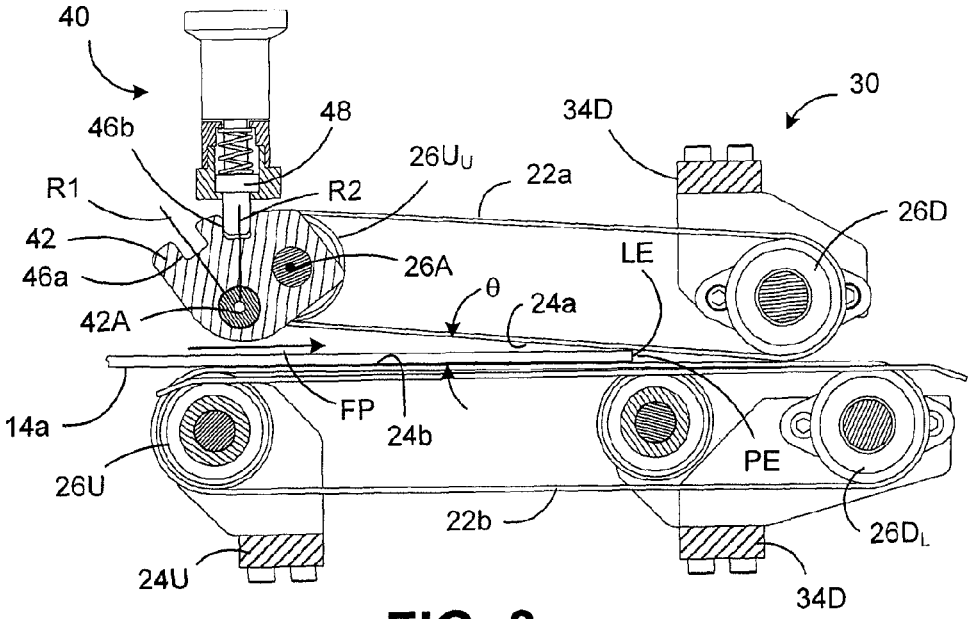
FIG. 3 is a sectional view taken substantially along line 3-3 of FIG. 1*b*, wherein the leading edge of the long sheet is accepted into the ingestion assembly at a second point of entry downstream of the first entry point.

More specifically, in FIGS. 2 and 3, the ingestion assembly 30 includes first and second transport belts 22*a*, 22*b* disposed in opposed relation to capture the sheet material 14*a* therebetween. Each of the transport belts 22*a*, 22*b* is continuous and disposed about upstream and downstream rolling elements 26U, 26D which are shaft mounted to stationary supports 34U, 34D (see FIGS. 1*a* and 1*b*) disposed above the ingestion assembly 30. In the described embodiment, a lower roller $\mathbf{26}D_L$ of the downstream elements is driven by a friction drive belt which cannot be seen in the perspective and cross-sectional views shown inasmuch as the belt is obscured by the second transport belt 22*b* of the ingestion assembly 30. Each of the transport belts 22*a*, 22*b* is fabricated from a urethane material having a high friction surface to convey the sheet material 14*a* without slippage or skewing along the feed path.

The ingestion assembly 30 also comprises a means 40 operative to displace at least one of the upstream rolling elements 26U in a direction substantially orthogonal to the feed path FP. In the described embodiment, an upper roller $\mathbf{26}U_U$ of the upstream elements 26U is displaced to vary the point of entry PE for accepting the leading edge LE of the sheet material 14*a*. In FIG. 2, the upper roller $\mathbf{26}U_U$ is displaced downwardly to a first position, toward the feed path FP, to effect a point of entry PE at a forward location along the feed path FP of the ingestion assembly 30. In FIG. 3, the upper roller $\mathbf{26}U_U$ is displaced upwardly to a second position, away from the feed path FP, to effect a point of entry PE at an aft or rearward location along the feed path FP of the ingestion assembly 30. Furthermore, while FIGS. 2 and 3 show two locations for effecting variable entry points PE, it will be appreciated that by varying an "ingestion angle θ" of the transport belts 22*a*, 22*b*, i.e., the point where the transport belts 22*a*, 22*b* in combination converge, the point of entry PE for accepting the leading edge LE of the sheet material can be at any forward, aft or intermediate position, depending upon the ingestion angle produced by the displacement means 40. Consequently, the ingestion assembly 30 can be modified to include a displacement means 40 capable of locating the upstream rolling element 26U at numerous locations to vary the entry point infinitely along the feed path FP.

In the described embodiment, the displacement means 40 include an eccentric link 42 and a means for pivoting the eccentric link 42 orthogonally away from the feed path FP to displace first transport belt 22*a* from the second transport belt 22*b*. More specifically, the eccentric link 42 is pivot mounted about a first rotational axis 42A to the upstream stationary support 34U of the ingestion assembly 30 at one end thereof, and pivot mounted to the upstream rolling element 26U about a second rotational axis 26A at the other end. In the described embodiment, the pivot means includes at least two detents 46*a*, 46*b* and a spring biased pin 48 operative to engage one of the detents 46*a*, 46*b* to retain the rotational position of the eccentric link 42 and the relative position of the first and second transport belts 22*a*, 22*b*. More specifically, the detents 46*a*, 46*b* are disposed about a peripheral surface of the eccentric link 42 at two radial positions R1, R2 relative to the first rotational axis 42A. When the eccentric link 42 is at the first radial position R1 as depicted in FIG. 2, the spring biased pin 48 engages the first detent 46*a* to retain the position of the link 42 and the relative position of the transport belts 22*a*, 22*b*. When the eccentric link 42 is caused to rotate to the second radial position R2, such as that depicted in FIG. 3, the pin 48 engages the second detent 46*b* to retain the position of the link 42. In the described embodiment, the elasticity of the first transport belt 22*a* acts to spring bias the eccentric link 42 in a clockwise direction relative to the first rotational axis 42A.

In FIGS. 1*a* through 3, the ingestion assembly 30 of the present invention is a passive device. That is, an operator acts to rotate the eccentric link 42 to each of its two rotational positions. Consequently, the ingestion assembly 30 can, in one operating mode, be configured to cut and accept short sheet material 14*a*, 14*b* such as the short inserts shown in FIG. 1*a*. In another operating mode, the ingestion assembly 30 can be configured to cut and accept long sheet material 14*a*, 14*b* such as the double sized sheets shown in FIG. 1*b*.

Figure 4:
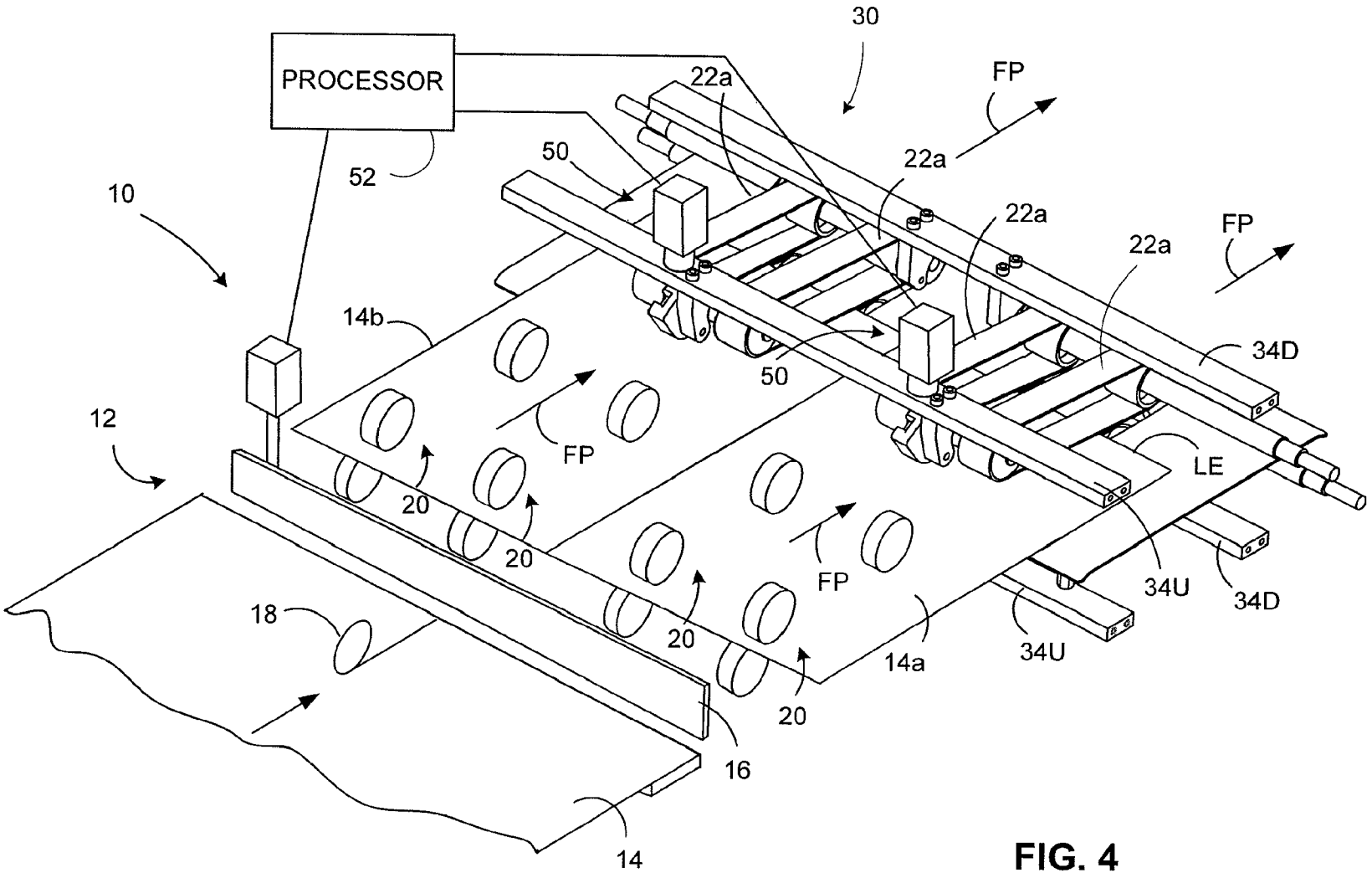
FIG. 4 is a perspective view of the feed input assembly including an actuation device and processor for adaptively reconfiguring the ingestion assembly to accept both short and long sheet material.
Figure 5:
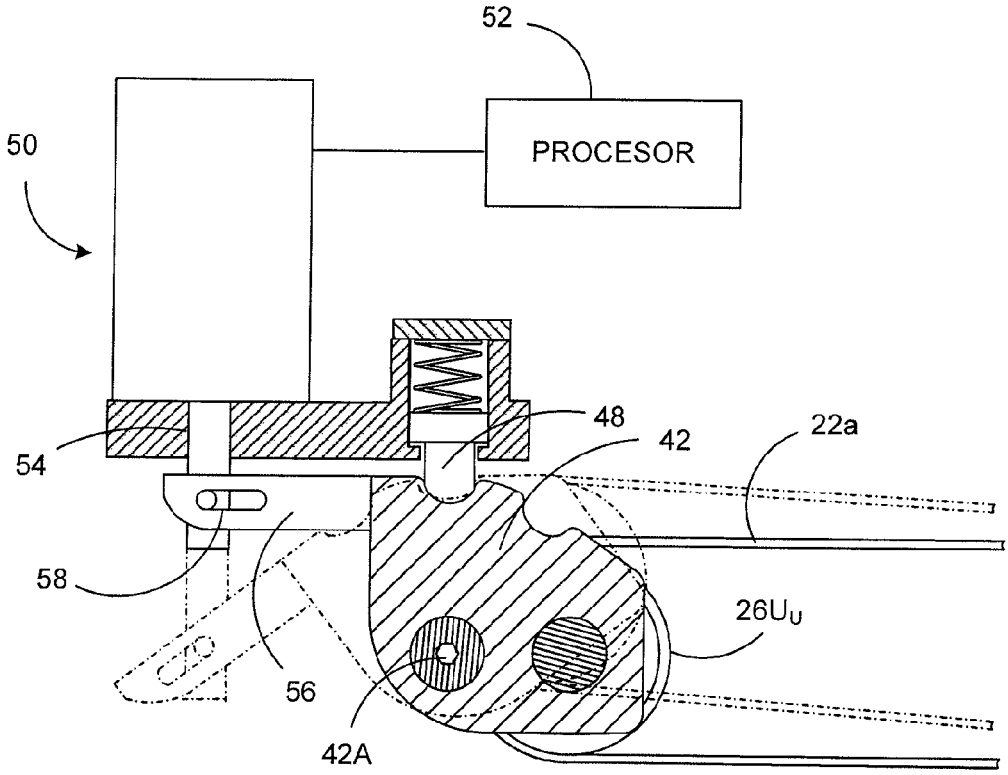
FIG. 5 is an enlarged, broken-away, sectional view of the actuator to reconfigure the ingestion assembly.

In FIGS. 4 and 5, another embodiment of the ingestion assembly 30 is shown wherein the pivot means is an active, rather than a passive device, i.e., wherein an operator manually pivots the eccentric link 42 into the two radial positions R1, R2. Therein the pivot means includes an actuator 50 operatively coupled to a processor 52 for adaptively reconfiguring the ingestion assembly 30 to accept both short and long sheet material 14*a*, 14*b*. In this configuration, the actuator 50 includes a linear actuation shaft 54 engaging an actuation arm 56 which connects to the eccentric link 42. The shaft 54 and actuation arm 56 are connected via a pin/slotted aperture connection 58 formed at one end of the actuation arm 58. In FIG. 5, the actuation arm 56 is shown in two positions wherein the upper roller 26UU is displaced upwardly by rotating the eccentric link 42 in a counterclockwise direction relative to the rotational axis 42A (shown in dashed lines) and downwardly by rotating the link 42 in a clockwise direction relative to the axis 42A (shown in solid lines). The pin/slotted aperture connection 58, therefore, accommodates the linear to rotational displacement of between the shaft 54 and eccentric link. In yet another embodiment, a simple rotary actuator may be employed to rotate the eccentric link 42 into position.

In summary, the feed input assembly of the present invention accepts variable length sheets from an upstream processing module, such as a cutting module, while minimizing the feed path of a mailpiece inserter. The feed input assembly includes a reconfigurable ingestion assembly 30 which accommodates both short and large sheet material while maintaining a constant spatial envelope.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

What is claimed is

1. A feed input assembly operative to accept and convey sheet material of variable length along a feed path, comprising:

a processing station performing an operation on the sheet material and conveying the sheet material along the feed path;

an ingestion assembly having transport elements including opposed friction drive surfaces adapted to capture the sheet material therebetween and accept a leading edge of the sheet material from the processing station at a point of entry, the ingestion assembly adapted to vary the position of the friction drive surfaces to vary point of entry along the feed path and including first and second transport belts disposed in opposed relation to capture the sheet material therebetween, each of the first and second transport belts being continuous and disposed about upstream and downstream rolling elements relative to the feed path; and, a displacement means operative to displace at least one of the upstream rolling elements in a direction substantially orthogonal to the feed path thereby varying the point of entry for accepting the leading edge of the sheet material, the displacement means, furthermore, including an eccentric link pivot mounted about a first rotational axis at one end and pivot mounted about a second rotational axis at the other end to the upstream rolling element and a means for pivoting the eccentric link to displace one of the transport belts from the other transport belt and vary the point of entry for accepting the leading edge of the sheet material, wherein, by varying the point of entry, sheet material of variable length can be accepted without varying the position of the processing station relative to the ingestion assembly.

2. The feed input assembly according to claim 1 wherein the transport belts, in combination, converge to define a ingestion angle which determines the location of the point of entry, and further comprising a means operative to vary the ingestion angle of the transport belts and the point of entry for accepting the leading edge of the sheet material.

3. The feed input assembly according to claim 1 wherein the pivot means includes at least two detents disposed about a peripheral surface of the eccentric link and at two radial locations relative to the rotational axis thereof, and a spring biased pin operative to engage one of the detents to retain the rotational position of the eccentric link and the relative position of the first and second transport belts.

4. The feed input assembly according to claim 1 wherein the pivot means includes an actuator operatively coupled to the eccentric link and a processor operative to activate the actuator such that the eccentric link rotates to vary the relative position of the first and second transport belts.

5. The feed input assembly according to claim 4 wherein the actuator includes an actuation arm connecting at one end to the eccentric link and having a slot shaped aperture at the other end, and wherein the actuator includes a linear actuation shaft engaging the slotted aperture of the actuation arm such that displacement of the actuation shaft effects rotation of the eccentric link.

6. The feed input assembly according to claim 5 wherein the actuator includes a rotating shaft and wherein the rotating shaft is coupled to the rotational axis of the eccentric link such that rotation of the shaft effects rotation of the eccentric link.

7. A method for accepting and conveying sheet material of variable length along a feed path, comprising the steps of:

performing an operation on the sheet material at a processing station and conveying the sheet material along the feed path;

transporting the sheet material into an ingestion assembly having transport elements including opposed friction drive surfaces adapted to capture the sheet material therebetween and accept a leading edge of the sheet material from the processing station at a point of entry, the ingestion assembly adapted to vary the position of the friction drive surfaces to vary point of entry along the feed path, the ingestion assembly including first and second transport belts disposed in opposed relation to capture the sheet material therebetween, each of the first and second transport belts being continuous and disposed about upstream and downstream rolling elements relative to the feed path, the transport belts, in combination, converging to define a ingestion angle for determining a point of entry;

displacing at least one of the upstream rolling elements in a direction substantially orthogonal to the feed path by (i) providing an eccentric link which is pivot mounted about a first rotational axis at one end and pivot mounted about a second rotational axis at the other end to the upstream rolling element, and (ii) pivoting the eccentric link to displace one of the transport belts relative to the other transport belt thereby varying the point of entry for accepting the leading edge of the sheet material; and varying the point of entry such that sheet material of variable length can be accepted without varying the position of the processing station relative to the ingestion assembly.

8. The method according to claim 7 wherein the step of pivoting the eccentric link includes the step of providing an actuator operative to rotate the eccentric link to vary the relative position of the first and second transport belts.

* * * * *